US010415210B2

(12) United States Patent
Powell et al.

(10) Patent No.: US 10,415,210 B2
(45) Date of Patent: Sep. 17, 2019

(54) DRIVE-OVER BERMS FOR PROTECTIVE CONTAINMENT LINERS

(71) Applicant: New Pig Corporation, Tipton, PA (US)

(72) Inventors: Beth P. Powell, State College, PA (US); Matthew J. Huff, Tyrone, PA (US); R. Douglas Evans, Everett, PA (US)

(73) Assignee: New Pig Corporation, Tipton, PA (US)

( * ) Notice: Subject to any disclaimer, the term of this patent is extended or adjusted under 35 U.S.C. 154(b) by 0 days.

(21) Appl. No.: 15/933,798

(22) Filed: Mar. 23, 2018

(65) Prior Publication Data

US 2018/0274199 A1 Sep. 27, 2018

Related U.S. Application Data

(60) Provisional application No. 62/476,139, filed on Mar. 24, 2017.

(51) Int. Cl.

| | |
|---|---|
| ***B65D 90/24*** | (2006.01) |
| ***E02D 31/00*** | (2006.01) |
| ***B08B 17/02*** | (2006.01) |
| ***E02B 7/02*** | (2006.01) |
| *E02B 3/10* | (2006.01) |

(52) U.S. Cl.

CPC ..... *E02D 31/004* (2013.01); *B08B 17/025* (2013.01); *B65D 90/24* (2013.01); *E02B 7/02* (2013.01); *E02B 3/106* (2013.01); *E02D 2300/001* (2013.01); *E02D 2300/0009* (2013.01); *E02D 2300/0012* (2013.01); *E02D 2300/0015* (2013.01); *E02D 2300/0026* (2013.01)

(58) Field of Classification Search

CPC ..... B65D 90/24; B65D 90/26; E02D 31/002; E02D 31/004; B08B 17/025

See application file for complete search history.

(56) References Cited

U.S. PATENT DOCUMENTS

| | | | | |
|---|---|---|---|---|
| 4,765,775 A * | 8/1988 | Kroger | B65D 90/24 | 405/129.8 |
| 5,454,195 A * | 10/1995 | Hallsten | B65D 90/24 | 220/495.01 |
| 6,258,430 B1 * | 7/2001 | Perlman | E04H 6/428 | 180/69.1 |
| 6,648,008 B1 * | 11/2003 | Price | B08B 17/00 | 134/104.2 |

(Continued)

FOREIGN PATENT DOCUMENTS

DE 102015004388 * 10/2016

*Primary Examiner* — Sean D Andrish

(74) *Attorney, Agent, or Firm* — Alan G. Towner; Leech Tishman Fuscaldo & Lampl

(57) ABSTRACT

Drive-over berm systems that protect raised sections of protective containment liners from truck and heavy equipment damage are disclosed. A ramped outer berm abuts an elevated portion of the liner, which may be raised to a desired height by an insert positioned under the liner. A ramped inner berm may about the elevated portion of the liner, and a connector plate may be used to secure the outer and inner ramped berms together. The height of the raised portion of the liner is selected to provide the desired sump capacity of the containment area. The inner berm and/or outer berm may be provided in sections that can be connected end-to-end.

23 Claims, 10 Drawing Sheets

(56) References Cited

U.S. PATENT DOCUMENTS

| | | | | |
|---|---|---|---|---|
| 2011/0309091 | A1* | 12/2011 | O'Connor | B65D 90/24 220/694 |
| 2013/0048630 | A1* | 2/2013 | Zajicek | B65D 90/24 220/4.13 |
| 2013/0272793 | A1* | 10/2013 | Denning | B65D 90/24 405/52 |
| 2014/0147212 | A1 | 5/2014 | Wheeler et al. | |
| 2014/0255108 | A1* | 9/2014 | McDowell | E02D 31/002 405/270 |

* cited by examiner

DRIVE-OVER BERMS FOR PROTECTIVE CONTAINMENT LINERS

CROSS-REFERENCE TO RELATED APPLICATIONS

This application claims priority from U.S. Provisional Application No. 62/476,139 filed Mar. 24, 2017, which is incorporated herein by reference.

FIELD OF THE INVENTION

The present invention is related to drive-over berms for protective containment liners.

BACKGROUND INFORMATION

During gas and oil drilling, thousands of gallons of drilling mud, fracturing chemicals and flowback water are on site. Many operating companies compact the pad site and place a liquid-proof liner over 30,000 to 120,000 square feet of surface. Around the perimeter of the containment area, the liner can be pulled over a raised row of dirt, railroad ties, corrugated pipe, foam block, or rubber/plastic forms to provide sidewalls, also known as berms. The liner in conjunction with the berms contains the leaks and spills that might happen on the site so that vacuum trucks can remove the waste without impact to the environment. The sump capacity of the containment is determined by multiplying the area of liner by the berm height.

There are many issues with the current berm options. An earthen berm requires heavy equipment to build. The liner cannot be directly attached and requires staking, which is subject to wind uplift and tearing. The earthen berms also flatten under repeated vehicle traffic.

Although railroad ties can be moved from site to site for reuse, they are difficult to decontaminate since they are absorbent to the chemicals on site. Because they are rectangular, they require metal or earthen ramps on both sides to accommodate bobcats, skid steers, front end loaders, and track hoes on and off the containment area. Any earthen ramp inside the containment area absorbs the chemicals and must be landfilled afterwards. To accommodate tractor trailer traffic, the railroad ties must be completely removed. Since durable liners are able to survive multiple operations during well construction, the berms may be removed and reinstalled up to five times. While the railroad tie berms are out of position, the containment has an open sidewall and negligible sump capacity. If a release occurs during that period, the liquids may flow off the containment.

Corrugated pipe is easy to decontaminate due to its plastic construction. It is also light weight and easy to move. It is, however, easily crushed and is unable to support a ramp. It does not provide a substantial physical barrier to traffic in sensitive areas and cannot be used in drive-over areas.

Triangular, circular and rectangular foam blocks underneath the liner provide berms that are crush resistant while also light weight. Containing the foam within a liner pocket prevents the foam from being pushed into the pad. To control wind uplift and foam migration out of the pocket, rock is placed on the liner tail outside the berm. While foam is the preferred berm for many operators, the liner on the berm is exposed to ongoing damage.

Another option is a plastic or rubber forms. Examples are 6 inch Muscle Walls from Muscle Wall Holding, LLC in Logan, Utah, and a rubber slotted base and key as disclosed in U.S. patent application Ser. No. 13/688,517. Again in both cases, the liner is pulled over the berms and is subject to ongoing damage. The first example, the plastic form from Muscle Wall, was designed for drive-over traffic but requires the liner to be exposed on the berm surface. The rubber form from U.S. patent application Ser. No. 13/688,517 requires ramps on drive-over sections since the rubber disintegrates under traffic. The rubber forms are also extremely heavy at around 200 pounds each and require a skid steer or multiple people to place.

In current methods mentioned above, the containment liner is pulled over the berm. It is thereby directly exposed to drive-over traffic and the associated punctures and tears that result from heavy equipment, fork tines, tires, etc. If a tear or puncture of the liner on the berm is inside the containment area, the overall sump capacity is reduced to the lowest point of the tear or puncture, requiring repair.

SUMMARY OF THE INVENTION

The present invention provides drive-over berm systems where a raised portion of the liner is protected within the berm. The berm system is stackable for storage and transportation purposes and includes plates and/or dove tails for connecting multiple sections of the berms end-to-end.

Containment systems of the present invention may be used to protect the environment from spills and leaks at sites, such as oil and gas well drilling sites, and more particularly relates to protecting the sidewalls of the containment, also known as berms. Trucks and heavy equipment frequently need to drive over the perimeter berms to access the equipment within the containment. Since the berms are higher than the liner inside and the gravel base outside of the containment, the berm can be damaged by turning tires, dragging frac tank rails and punctures from lowered fork tines. Damaging the berm compromises the containment since the overall sump capacity is determined by multiplying the berm height by the liner area.

An aspect of the present invention is to provide a drive-over containment liner system comprising an inner berm comprising a base, an outwardly facing sidewall, and an inwardly facing ramp surface; an outer berm comprising a base, an inwardly facing sidewall, and an outwardly facing ramp surface; and a liner sheet extending under the base of the inner berm and having a folded portion between the outwardly facing sidewall of the inner berm and the inwardly facing sidewall of the outer berm defining an elevated liner fold forming a liquid containment barrier.

Another aspect of the present invention is to provide an outer berm for use with a liquid impermeable liner of a drive-over containment layer system, the outer berm comprising a base; a sidewall extending upwardly from the base; a top surface extending substantially perpendicularly from a top edge of the sidewall; a ramp surface extending downwardly at an angle from the top surface toward the base; and a channel formed in the top surface running along a length of the outer berm structured and arranged to receive a downwardly extending side edge of a connector plate.

A further aspect of the present invention is to provide an inner berm for use with a liquid impermeable liner of a drive-over containment layer system, the inner berm comprising a base; a sidewall extending upwardly from the base; a top surface extending substantially perpendicularly from a top edge of the sidewall; a ramp surface extending downwardly at an angle from the top surface toward the base; and a channel formed in the top surface running along a length of the inner berm structured and arranged to receive a downwardly extending side edge of a connector plate.

These and other aspects of the present invention will be more apparent from the following description.

DETAILED DESCRIPTION

The present invention provides an enclosed berm system for use with a protective liner. If the inside containment is in the same plane as the area outside, two ramps may be used to drive up one side and down the other. If the inside containment is raised, such as by rig mats, only the entrance or outer ramp may be needed. For a two-ramp berm, each section may include an inner ramp, an outer ramp, a connector plate, and an insert to raise the liner to desired sump height. For a berm attaching to a rig mat, at least one outer ramp and a connector plate may be used. If the liner is not double-backed onto a rig mat under the connector plate, an insert to raise the liner may be used.

Figure 1:
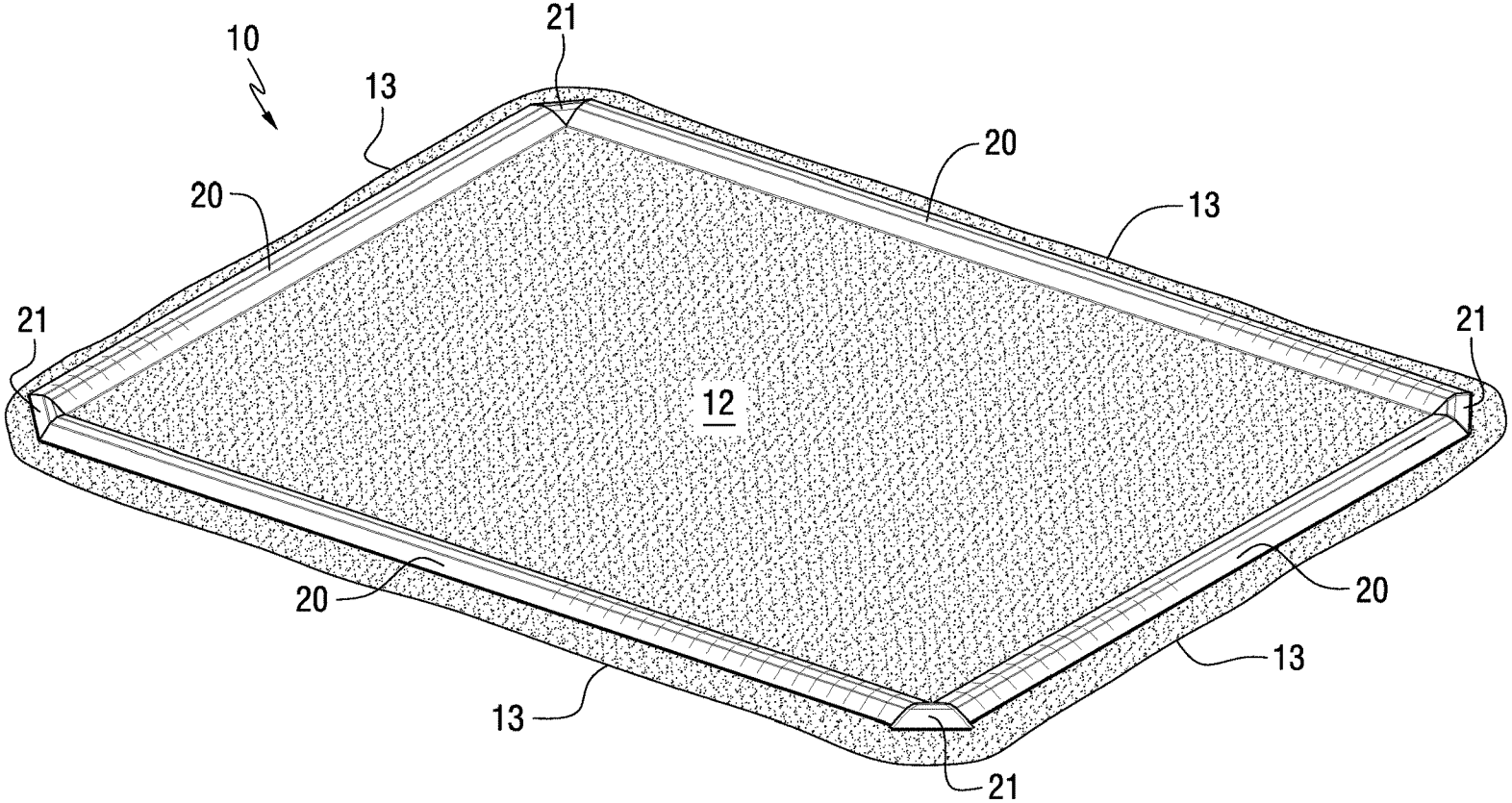
FIG. 1 is an isometric view of a drive-over containment liner system in accordance with an embodiment of the present invention.

FIG. 1 illustrates a drive-over containment liner system 10 in accordance with an embodiment of the present invention. The drive-over containment liner system 10 includes a protective liner 12 having an outer peripheral edge 13. The protective liner 12 may be made of any suitable layer or layers of material known to those skilled in the art that provide sufficient liquid impermeability. A drive-over berm 20 with corner pieces 21 provides a containment area. Although the drive-over berm 20 extends around the entire periphery of the liner 12 in the embodiment shown in FIG. 1, stand-alone drive-over berm sections can be used at limited locations on the periphery of the liner 12. For example, one side of the liner 12 may include the drive-over berm 20 in a high traffic area, while the other sides may include different types of berms. As a further example, on a given side of a liner, a portion of the berm may comprise a drive-over berm 20 of the present invention while another portion of the berm may be of conventional design.

Figure 2:
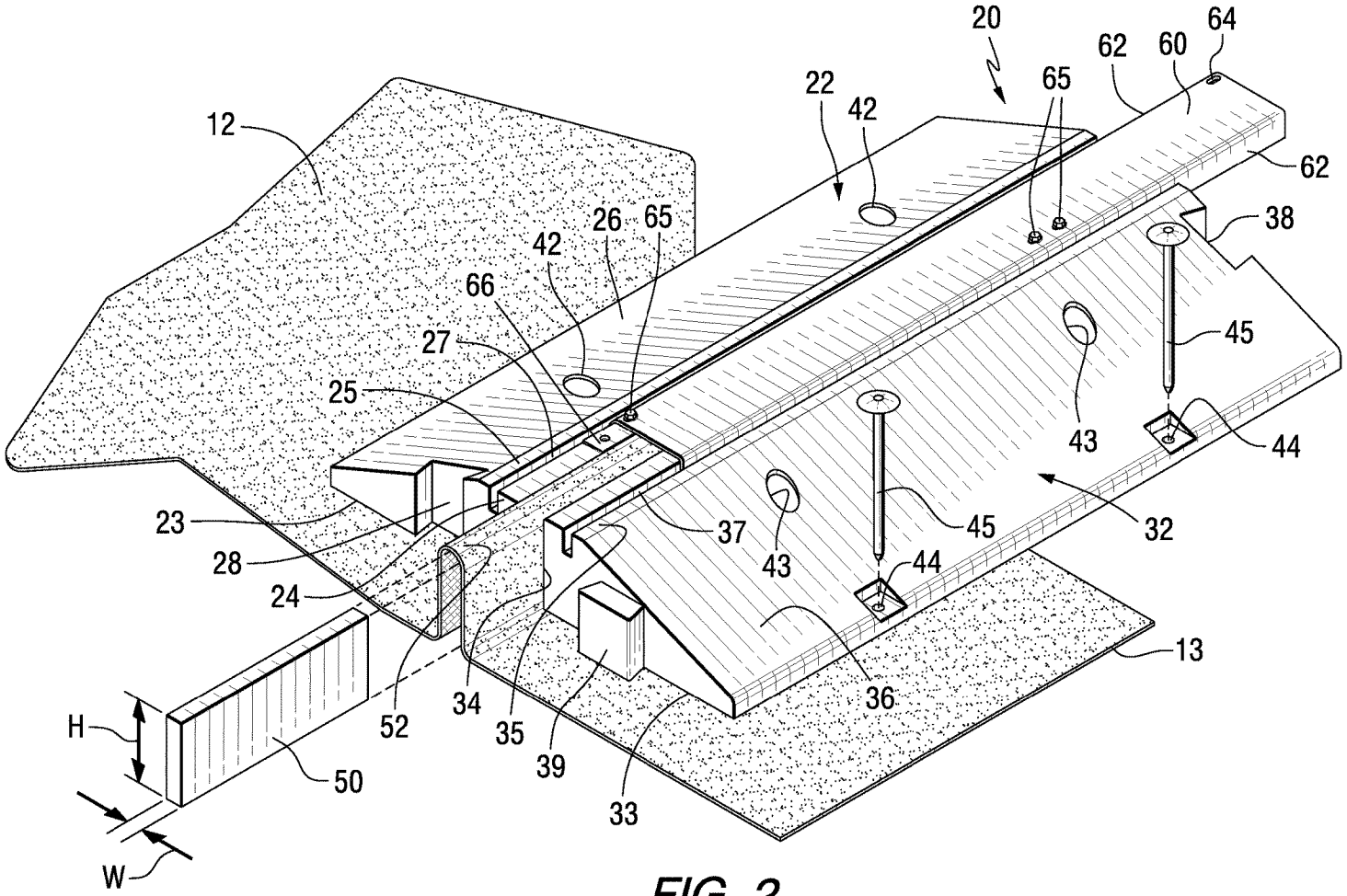
FIG. 2 is an isometric view of a drive-over berm in accordance with an embodiment of the present invention.

FIG. 2 illustrates a section of a drive-over berm 20 in accordance with an embodiment of the present invention. The drive-over berm 20 includes an inner berm 22 and an outer berm 32. The inner berm 22 includes a base 23, sidewall 24, top surface 25 and ramp surface 26. A top channel 27 is provided in the top surface 25 of the inner berm 22. An end groove 28 is provided at one end of the inner berm 22, and an end tongue 29 is provided at the other end, as shown most clearly in FIG. 7. The tongue 29 and groove 28 allow sections of the inner berm 22 to be connected together end-to-end.

As further shown in FIG. 2, the outer berm 32 includes a base 33, sidewall 34, top surface 35 and ramp surface 36. A top channel 37 is provided in the top surface 35. An end groove 38 is provided at one end of the outer berm 32, and an end tongue 39 is provided at the other end. The tongue 39 and groove 38 allow sections of the outer berm 32 to be connected together end-to-end.

As shown in FIG. 2, inner ramp holes 42 are provided in the ramp surface 26 of the inner berm 22. Outer ramp holes 43 are provided in the ramp surface 36 of the outer berm 32. Recessed fastener holes 44 are provided near the bottom of the ramp surface 36 of the outer berm 32. The recessed fastener holes 44 receive fasteners 45 for securing the outer berm 32 to the ground.

As further shown in FIG. 2, a riser insert 50 is positioned under the liner 12 to provide an elevated liner fold 52. The insert 50 is installed between the sidewall 24 of the inner berm 22 and the sidewall 34 of the outer berm 32. The insert 50 has a height H and a width W. The height H is selected in order to provide the desired elevation for the liner fold 52. In certain embodiments, the height H of the insert 50 is approximately the same as the heights of the inner berm sidewall 24 and outer berm sidewall 34. The height H may typically range from 3 to 12 inches, for example, from 4 to 8 inches. The width W of the insert 50 is selected in order to provide sufficient structural integrity to hold the elevated liner fold 52 in the desired position while minimizing the required spacing distance between the inner berm 22 and outer berm 32. The length of the riser insert 50 may be selected as desired. In certain embodiments, the length of the insert 50 may be limited to the region near the ends of the inner and the outer berms 22 and 32. In other embodiments, the insert 50 may extend the entire lengths of the inner and outer berms 22 and 32, or may extend beyond the ends of the inner and outer berms 22 and 32.

In accordance with embodiments of the invention, the insert 50 ensures that the liner 12 maintains a determined sump height. The insert 50 can be square, rectangular, T-shaped, L-shaped, arched, or other shapes to provide the desired height H. It may or may not engage with the ramps and/or connector plate. The insert 50 can be held in place between the ramps 22 and 32 by constrained space, contact, gravity, friction, bends, book ends, or pins and screws that do not puncture the inside surface of the liner 12.

As shown in FIG. 2, a connector plate 60 is used to secure the inner and outer berms 22 and 32 together. The connector plate 60 includes two downwardly extending side edges 62. The inner downwardly extending side edge 62 fits within the top channel 27 of the inner berm 22, and the outer downwardly extending side edge 62 fits within the top channel 37 of the outer berm 32. Holes 64 are provided in the connector plate 60 near the side edges 62. Mechanical fasteners 65 are installed through the holes 64 into the top surfaces 25 and 35 of the inner and outer berms 22 and 32. An extended tab 66 is provided at one end of the connector plate 60, which allows another connector plate (not shown) to be mechanically fastened end-to-end with the adjacent connector plate 60.

In accordance with embodiments of the present invention, the shapes of the inner and outer berms 22 and 32 may be selected as desired, for example, triangular, arched, or stepped. The length of each inner berm section 22 and outer berm section 32 may typically range from 2 to 20 feet, for example from 4 to 8 feet. The overall heights of the inner and outer berms 22 and 32 may typically range from 3 to 12 inches, for example from 4 to 8 inches. To ease field installation, each individual berm section should weigh less than 50 pounds, ideally around 30 pounds, to limit fatigue. The inner and outer berms 22 and 32 may be solid or hollow and could be made from various construction grade materials, such as plastic, reinforced plastic, wood, metal, composites, or rubber. As such, the desired shape can be obtained by injection molding, machining, casting, extrusion, fabrication or other common methods.

The connector plate 60 secures the berm sections in order to prevent shifting. The connector plate 60 protects the elevated liner fold 52 underneath from direct traffic and is mechanically fastened to prevent separation. The connector plate 60 may be made of various construction grade materials, such as plastic, reinforced plastic, wood, metal, or composites that provide rigidity. As such, the desired shape can be obtained by bending, injection molding, machining, casting, extrusion, fabrication or other common methods. To ease field installation, each individual plate 60 weight should weigh less than 50 pounds, ideally around 30 pounds, to limit fatigue. This does not, however, limit the invention to components that weight less than 50 pounds. Ideally, the connector plate 60 should span across adjacent berm sections to lock the entire system together.

During installation, one of the inner berm 22 sections may be placed on top of the liner 12. The liner 12 is folded back over the inner berm 22 so the insert 50 can be positioned. The liner 12 is then folded back down onto the ground and the outer berm 32 is placed on top of the liner 12. The connector plate 60 is then bolted or otherwise fastened onto the inner and outer berms 22 and 32. The connector plate 60 can span across two or more adjacent inner berm 22 sections and outer berm 32 sections to interconnect them together. Any excess liner 12 on the outside side 13 can be trimmed away if desired or rock may be placed on top of it.

Figure 3:
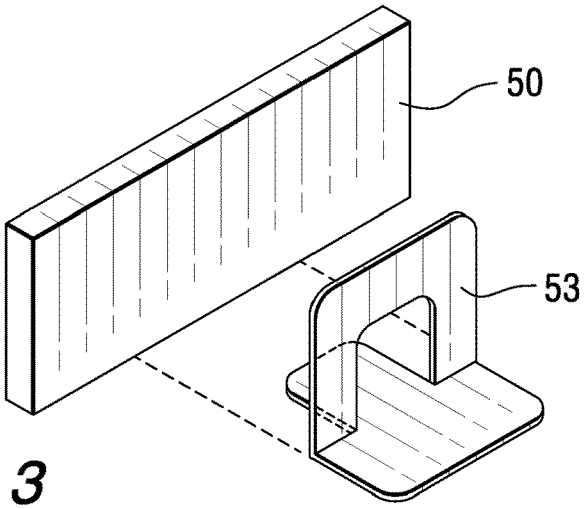
FIG. 3 is an isometric view of a riser insert for elevating a protective liner of a drive-over berm in accordance with an embodiment of the present invention.
Figure 4:
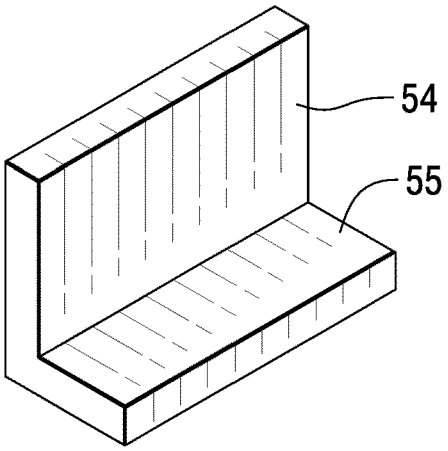
FIG. 4 is an isometric view of a riser insert for elevating a protective liner of a drive-over berm in accordance with another embodiment of the present invention.
Figure 5:
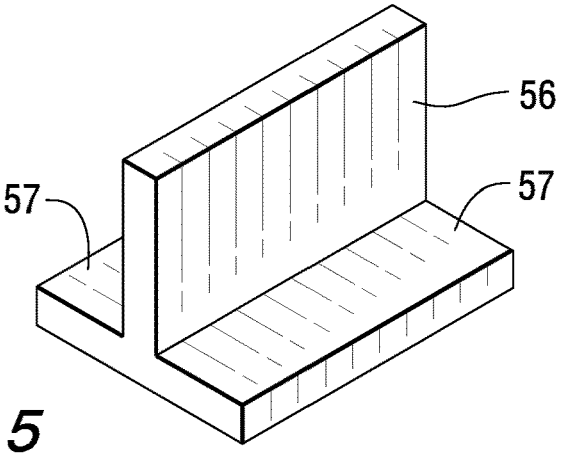
FIG. 5 is an isometric view of a riser insert for elevating a protective liner of a drive-over berm in accordance with a further embodiment of the present invention.

FIGS. 3-5 illustrate riser inserts in accordance with embodiments of the present invention. In FIG. 3, the insert 50 has a rectangular cross-section, and may be held in a vertical position by a bracket 53 resembling a book end. In the embodiment shown in FIG. 4, the insert 54 is generally L-shaped with a base 55 extending laterally in one direction therefrom. In the embodiment shown in FIG. 5, the insert 56 is generally T-shaped with lower legs 57 extending in both directions laterally therefrom.

Figure 6:
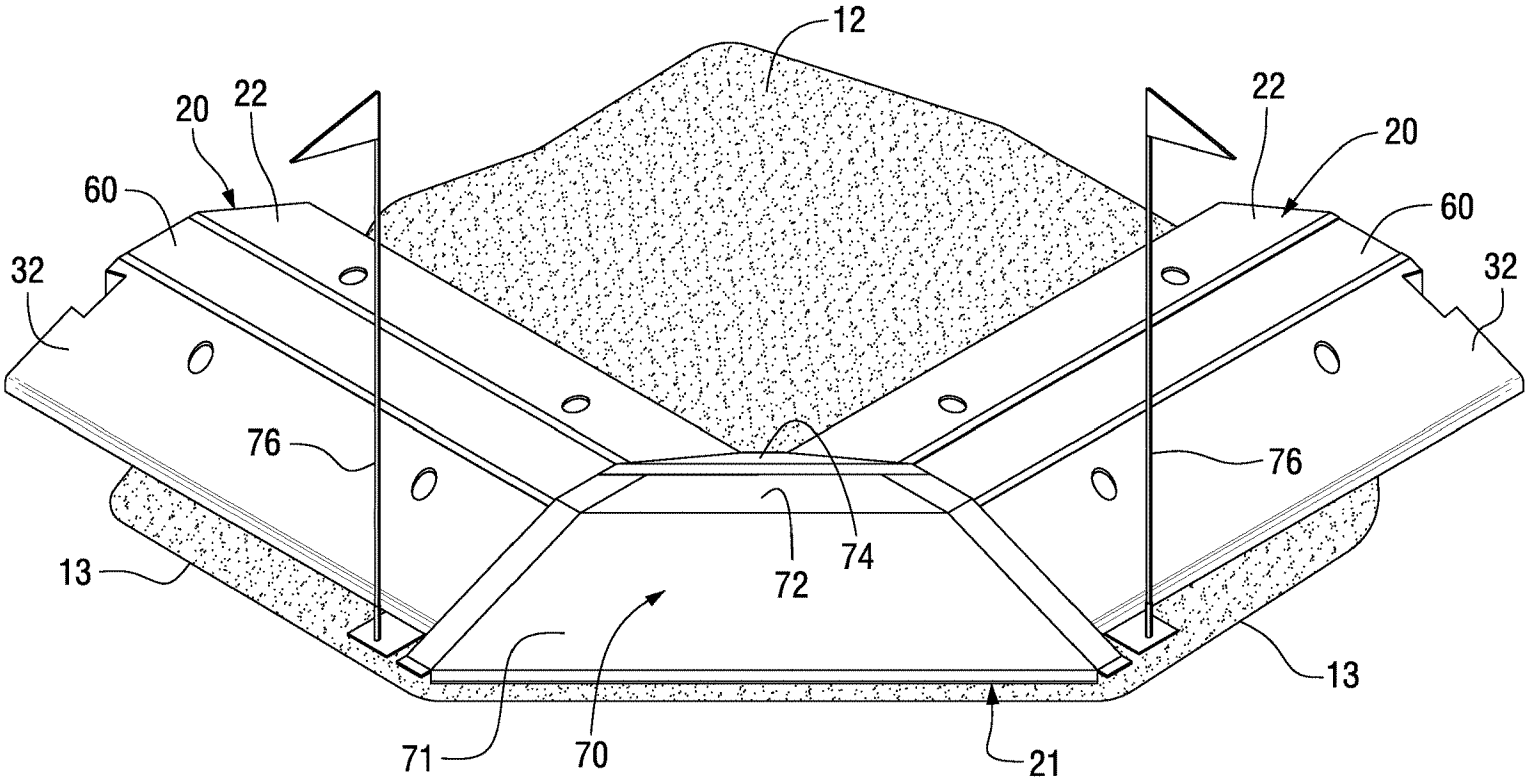
FIG. 6 is an isometric view of a corner piece of a drive-over berm in accordance with an embodiment of the present invention.
Figure 7:
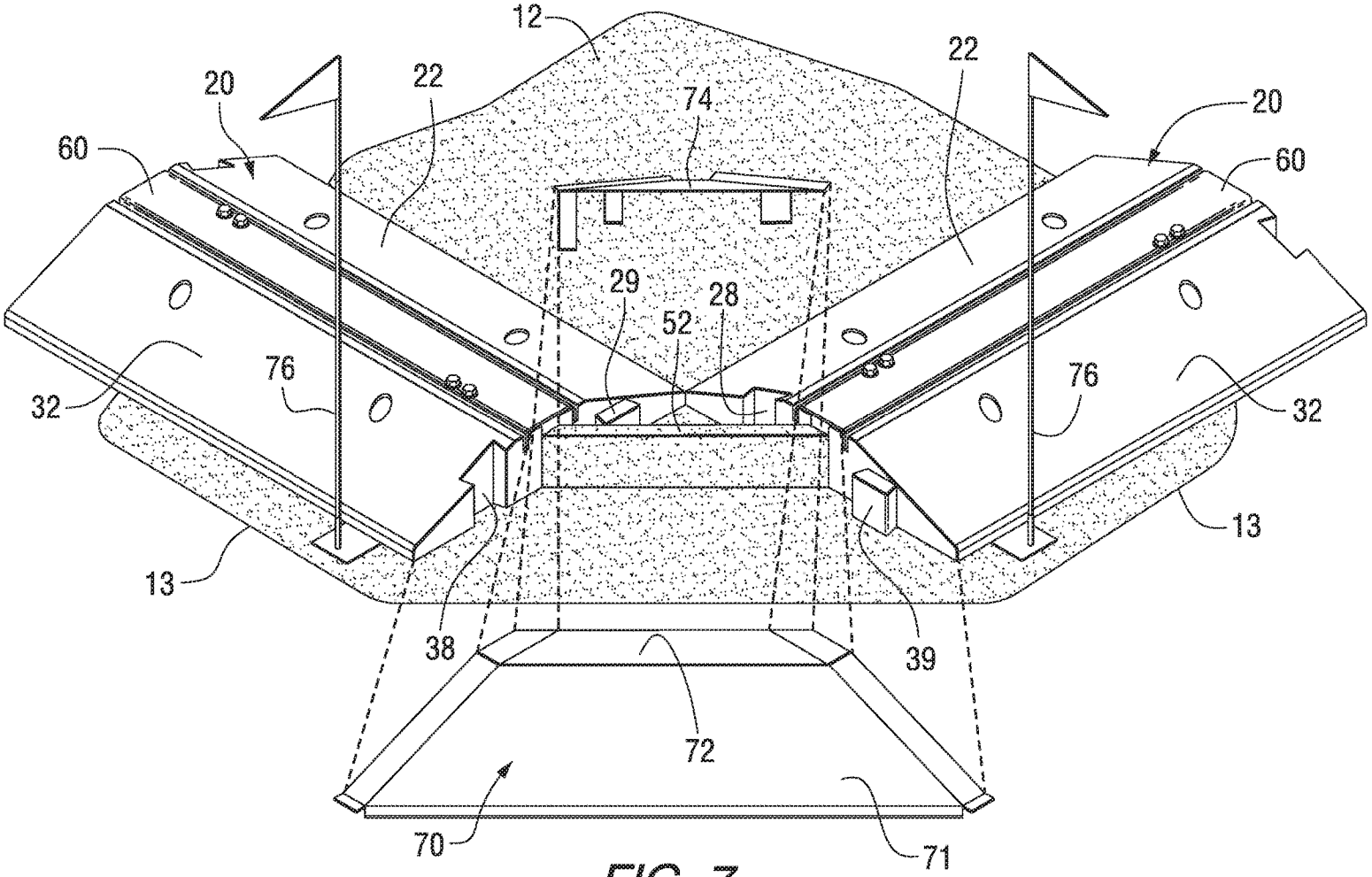
FIG. 7 is an exploded isometric view of the drive-over berm corner piece of FIG. 6.

FIGS. 6 and 7 illustrate details of a berm corner piece 21 in accordance with an embodiment of the present invention. The corner piece 21 includes an outer corner cover 70 having an outer ramped surface 71 and a top surface 72. The berm corner piece 21 also includes an inner corner cover 74. As shown in the exploded view of FIG. 7, the outer corner cover 70 is installed over adjacent outer berms 32 and connector plates 60. As further shown in FIG. 7, the inner corner cover 74 is installed over adjacent inner berms 22. The elevated liner fold 52 extends underneath the outer corner cover 70 to provide liquid containment at the corner 21 of the drive-over berm 20. An insert as described above (not shown) may be provided under the elevated liner fold 52 at the corner. As further shown in FIGS. 6 and 7, corner flags 76 may be used to mark the location of the corner piece 21, e.g., in order to avoid vehicular or other traffic over the corner region 21 of the berm 20.

Figure 8:
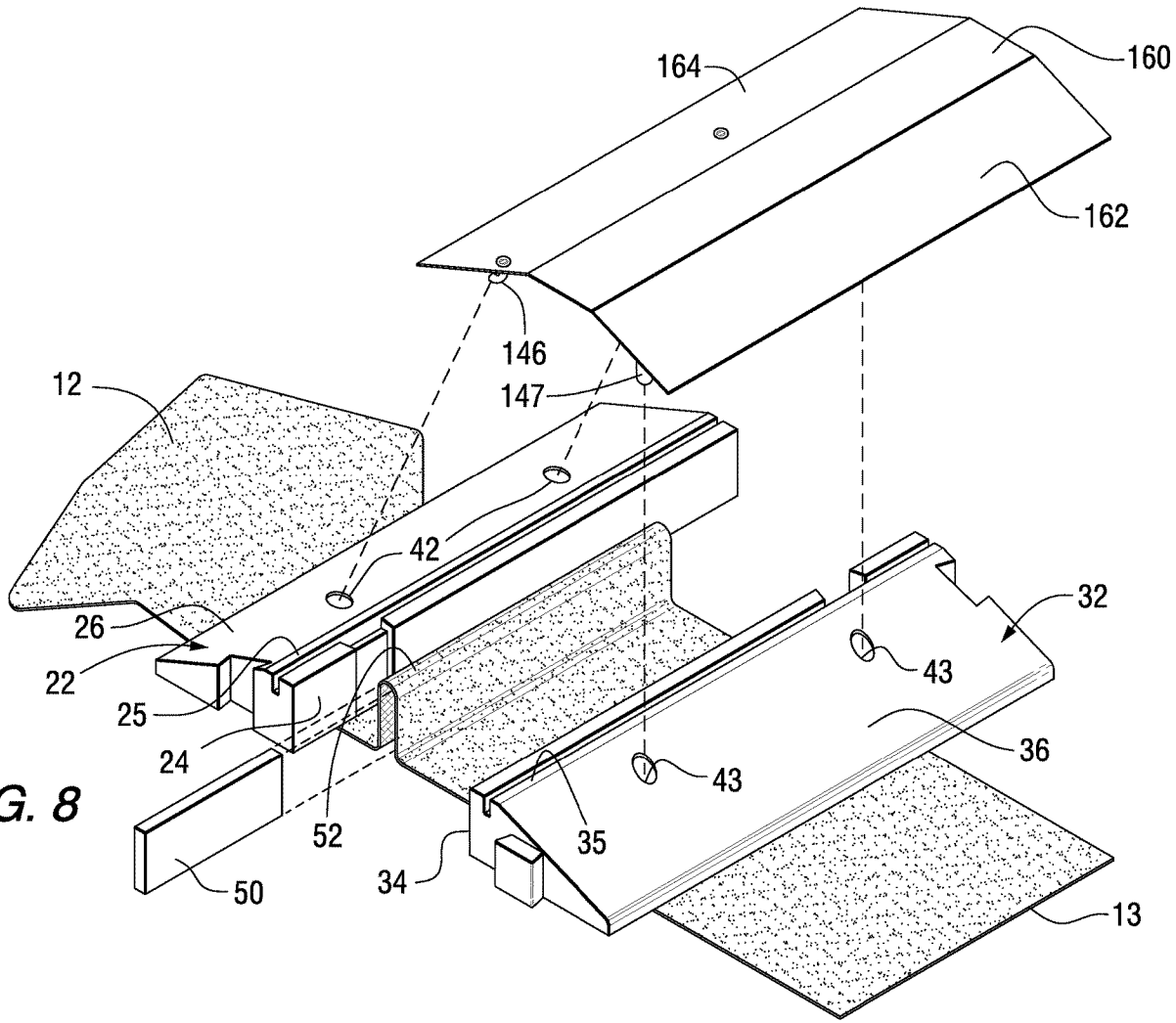
FIG. 8 is an isometric view of a drive-over berm in accordance with another embodiment of the present invention.

FIG. 8 illustrates a drive-over berm having a relatively wide connector plate 160 in accordance with an embodiment of the present invention. The wide connector plate 160 includes an outer ramp cover 162 and an inner ramp cover 164. The outer and inner ramp covers 162 and 164 are sized to cover the outer ramp surface 36 and inner ramp surface 26, respectively. Cam hooks 146 are provided on the underside of the inner ramp cover 164 for engagement within the inner ramp holes 42 of the inner berm 22. Connector pins 147 extend downward from the outer ramp cover 162 for engagement within the outer ramp holes 43 in the outer ramp surface 36 of the outer berm 32. In comparison with the relatively narrow connector plate 60 shown in the embodiment of FIG. 2, the relatively wide connector plate 160 shown in the embodiment of FIG. 8 covers essentially the entire inner and outer berm ramp surfaces 26 and 36. As shown in FIG. 8, a riser insert 50 similar to that shown in the embodiment of FIG. 2 is used to support the elevated liner fold 52.

Figure 9:
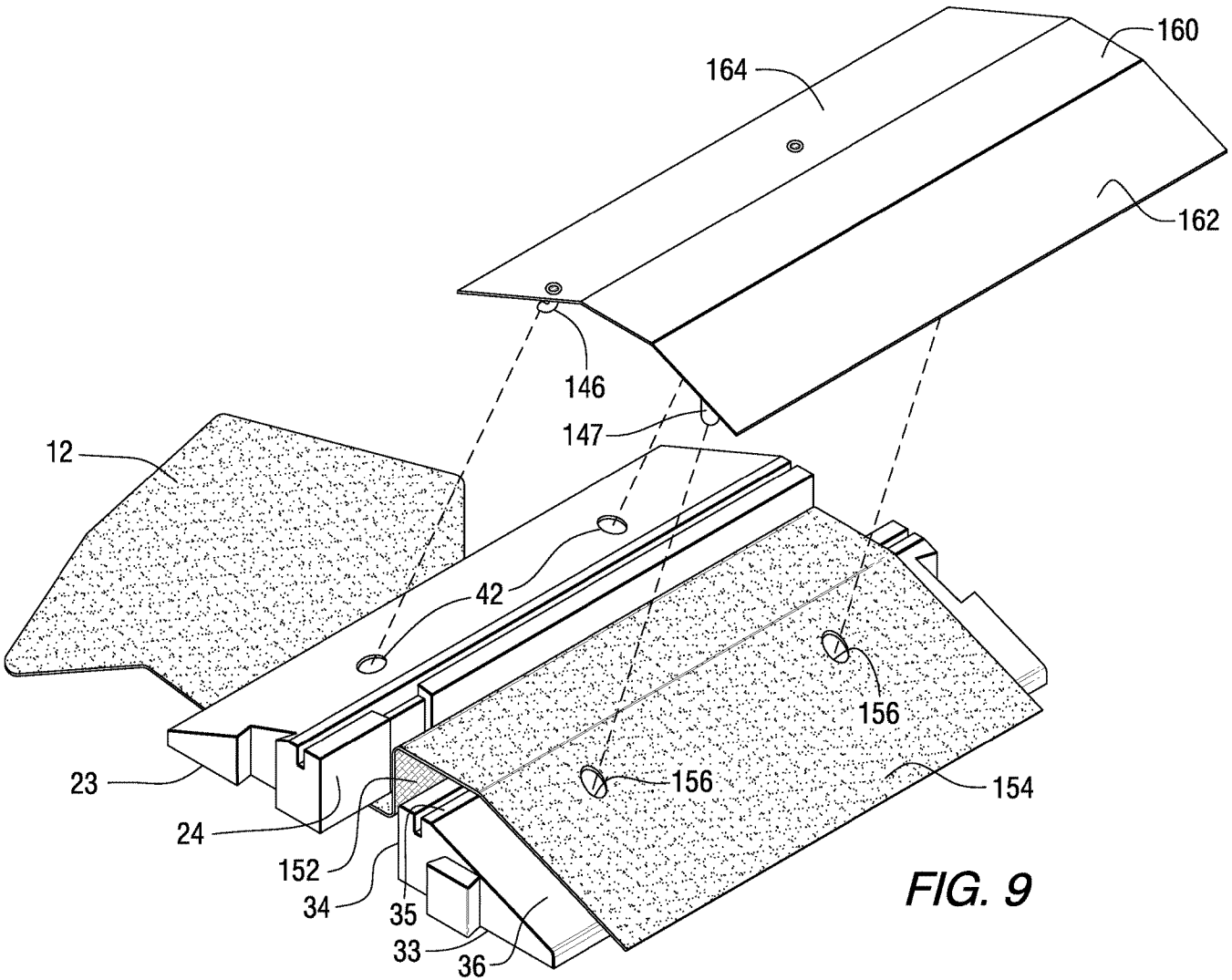
FIG. 9 is an isometric view of a drive-over berm in accordance with a further embodiment of the present invention.

FIG. 9 illustrates another embodiment of the present invention in which the liner 12 is not folded over an insert 50 as shown in the embodiments of FIGS. 2 and 8, but rather extends upward in a folded region 152 between the inner and outer sidewalls 24 and 34 of the inner and outer berms 22 and 32, and further extends over the top surface 35 and ramp surface 36 of the outer berm 32. The portion of the liner 12 covering the outer ramp surface 36 is labeled as element 154 in FIG. 9. In this embodiment, the connector pins 147 extending downward from the outer ramp cover 162 of the wide connector plate 160 may pass through holes 156 or indents in the liner 154 and into the outer ramp holes 43 in the outer berm 32.

Figure 10:
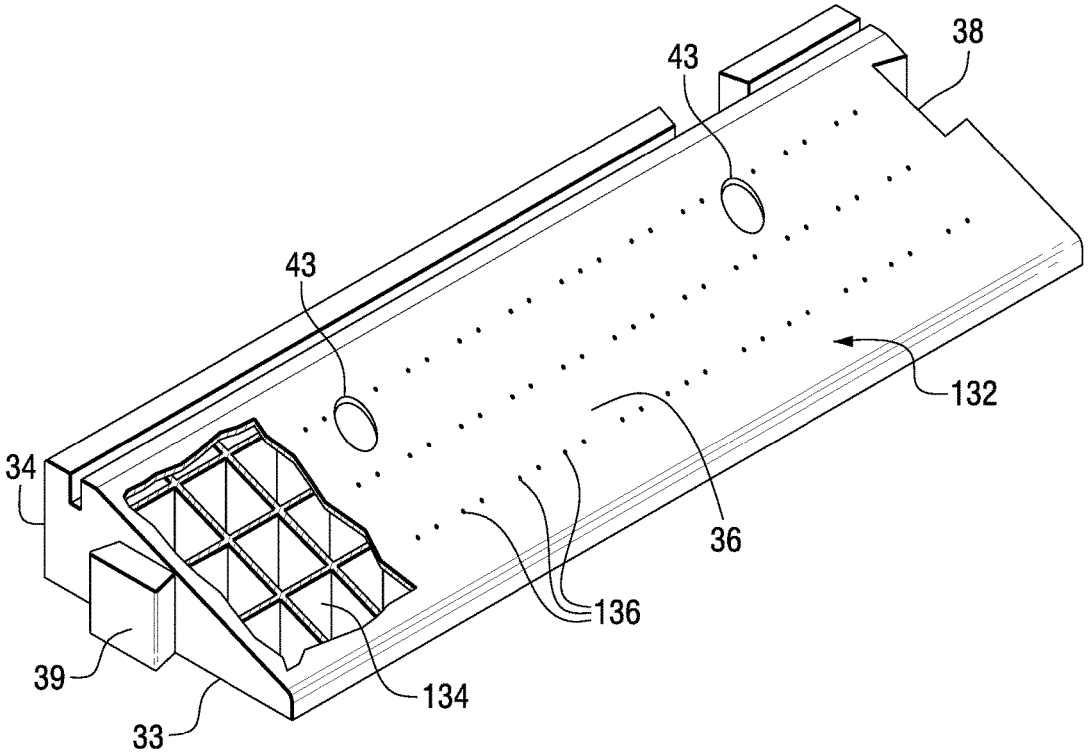
FIG. 10 is an isometric view of a drive-over berm section in accordance with an embodiment of the present invention.

FIG. 10 illustrates a section of an outer berm 132 in accordance with an embodiment of the present invention. The outer ramp surface 36 is supported by an inner support wall grid 134 in order to provide structural integrity to the outer berm 132. A series of perforations 136 extend through the outer ramp surface 36 to allow air to escape from the interior volume of the berm, e.g., to reduce buoyancy.

Figure 11:
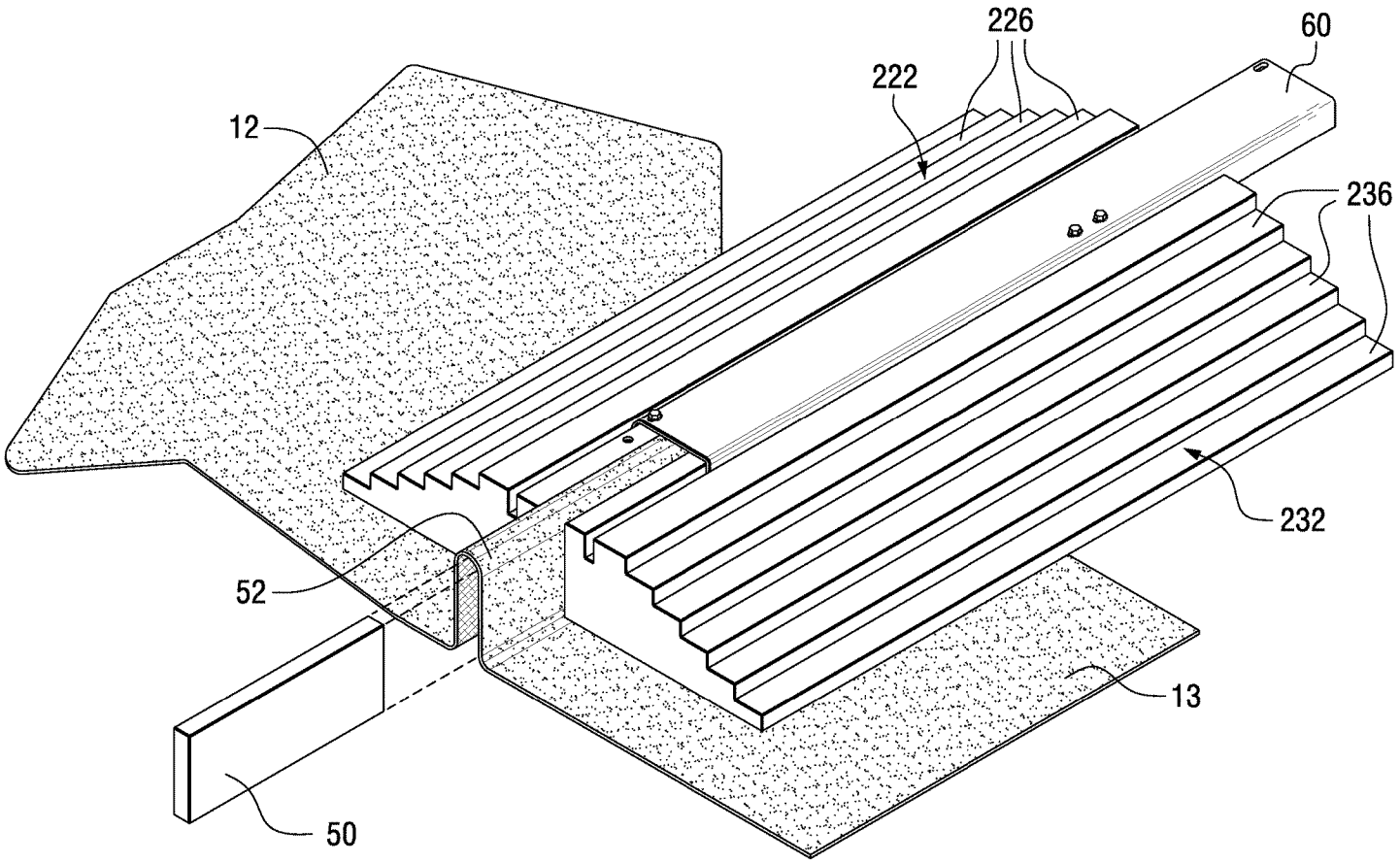
FIG. 11 is an isometric view of a drive-over berm in accordance with an embodiment of the present invention.

FIG. 11 illustrates a stepped inner berm 222 and stepped outer berm 232 in accordance with an embodiment of the present invention. The stepped inner berm 222 includes a series of steps 226. The stepped outer berm 232 also includes a series of outer steps 236. Otherwise, the drive-over berm shown in FIG. 11 is similar to the embodiment shown in FIG. 2.

Figure 12:
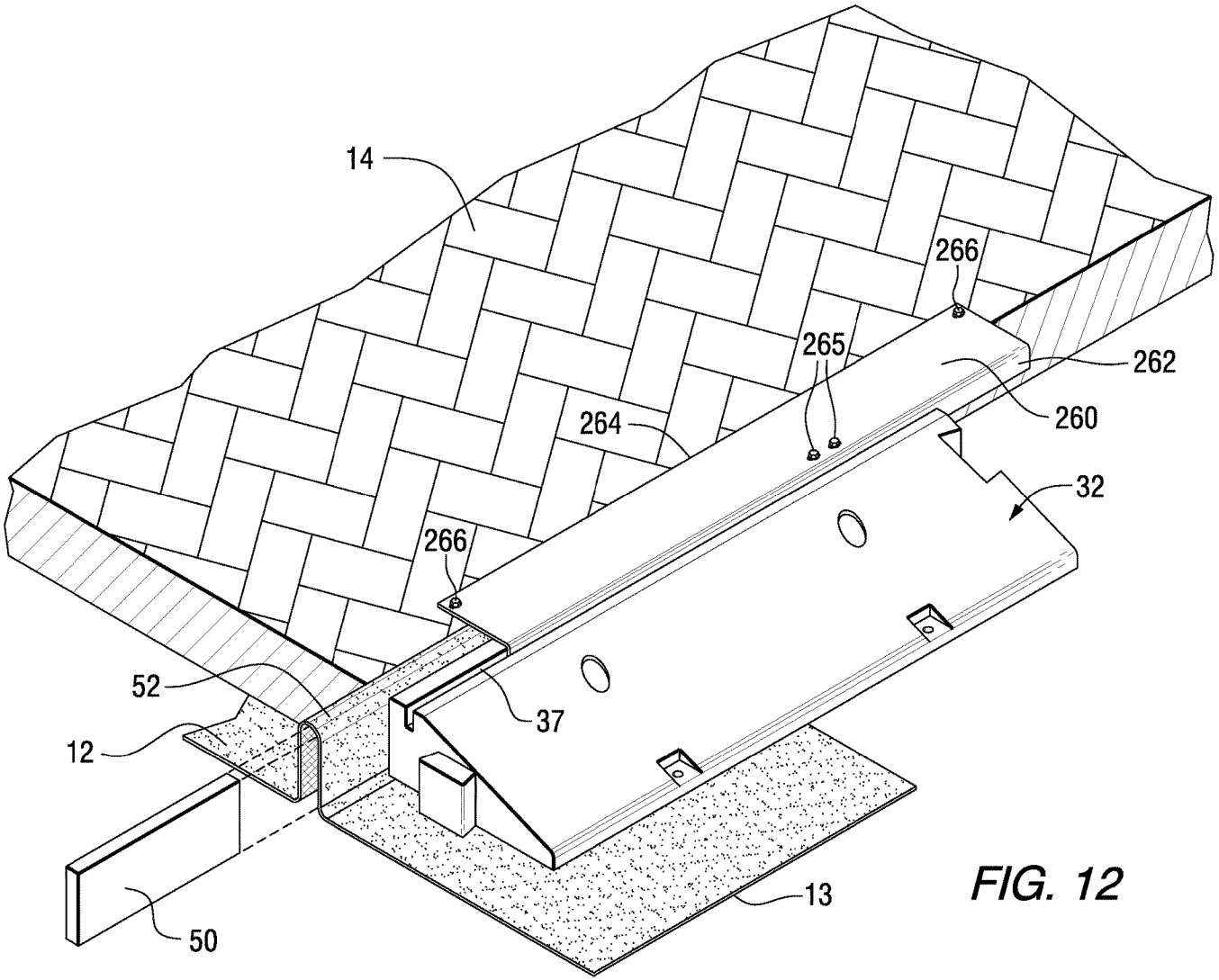
FIG. 12 is an isometric view of a drive-over berm in accordance with another embodiment of the present invention.

FIG. 12 illustrates a drive-over berm in accordance with another embodiment of the present invention in which a relatively thick rig mat 14 is positioned over the protective liner 12. In this embodiment, the height of the rig mat 14 is sufficient to reach the height of the outer berm 32, eliminating the need for an inner berm. An L-shaped connector plate 260 having a downwardly extending side edge 262 is received within the top channel 37 of the outer berm 32. The L-shaped connector plate 260 includes a flat-side edge 264 that extends over the edge of the rig mat 14. Mechanical fasteners 265 may be used to secure the connector plate 260 to the outer berm 32, and other mechanical fasteners 266 may be used to secure the connector plate 260 to the rig mat 14.

The berm systems of the present invention may be made of any suitable materials, such as molded or extruded plastics and rubbers, wood or metal. Suitable plastics include polypropylene and polyethylene such as impact copolymer, high-density polyethylene (HDPE), medium-density polyethylene (MDPE), low-density polyethylene (LDPE) and linear low-density polyethylene (LLDPE), and the like. In certain embodiments, the plastic may comprise recycled materials. Other materials, fillers, or composites can also be used. In certain embodiments, recycled plastic resin from liners used in previous well site containments may be used to make the berms. In another embodiment, the inner and outer berms 22 and 32, and the connector plates 60, 160 and 260 can be made out of high-traction materials or covered with high-traction coatings or tapes.

The berm sections can be interconnected to prevent shifting between sections. The interconnected pieces may include tongue and groove assemblies in the ramps as described above, spanning the connector plate over two or more sections, pins, rods or screws. Interlocking sections prevent sections of berm system from being pushed out of alignment. The interlocking devices can be designed to accommodate for thermal expansion and contraction. For example, plates can have slots for screws or gaps can be left between sections during day installation or placed tight for night installations.

The berms of the present invention provide several advantages over other berm containment methods. They provide a ramp that completely protects the liner, stays in place, can be decontaminated and can be easily moved from site to site.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined.

What is claimed is:

1. A drive-over containment liner system comprising:

an inner berm comprising a base, an outwardly facing sidewall, and an inwardly facing ramp surface;

an outer berm comprising a base, an inwardly facing sidewall, and an outwardly facing ramp surface, wherein at least one of the inwardly facing ramp surface of the inner berm and the outwardly facing ramp surface of the outer berm is perforated;

a liner sheet extending under the base of the inner berm and having a folded portion between the outwardly facing sidewall of the inner berm and the inwardly facing sidewall of the outer berm defining an elevated liner fold comprising an upwardly extending portion of the liner and a downwardly extending portion of the liner forming a liquid containment barrier; and a riser insert located between the upwardly and downwardly extending portions of the liner having an upper support edge structured and arranged to hold the liner fold at an elevated position.

2. The drive-over containment liner system of claim 1, wherein the riser insert has a height substantially the same as a height of the outwardly facing sidewall of the inner berm or substantially the same as a height of the inwardly facing sidewall of the outer berm.

3. The drive-over containment liner system of claim 1, wherein the riser insert comprises a substantially rectangular cross section.

4. The drive-over containment liner system of claim 1, wherein the riser insert comprises at least one leg portion extending laterally from a base thereof.

5. The drive-over containment liner system of claim 1, wherein the liner extends under the base of the outer berm.

6. The drive-over containment liner system of claim 1, wherein the liner fold comprises an upwardly extending portion of the liner, and the liner extends from the upwardly extending portion over the outwardly facing ramp surface of the outer berm.

7. The drive-over containment liner system of claim 1, further comprising a connector plate secured to the inner berm and the outer berm.

8. The drive-over containment liner system of claim 7, wherein the connector plate comprises a downwardly extending outer side edge engaged in a channel in a top surface of the outer berm.

9. The drive-over containment liner system of claim 8, wherein the connector plate comprises a downwardly extending inner side edge engaged in a channel in a top surface of the inner berm.

10. The drive-over containment liner system of claim 9, wherein the connector plate is mechanically fastened to the inner berm and outer berm.

11. The drive-over containment liner system of claim 7, wherein the connector plate substantially covers the outwardly facing ramp surface of the outer berm.

12. The drive-over containment liner system of claim 11, wherein the connector plate substantially covers the inwardly facing ramp surface of the inner berm.

13. The drive-over containment liner system of claim 1, wherein at least one of the inwardly facing ramp surface of the inner berm and the outwardly facing ramp surface of the outer berm is stepped.

14. The drive-over containment liner system of claim 1, wherein a rig mat at least partially covers the liner and has a height substantially the same as a height of the inwardly facing sidewall of the outer berm.

15. The drive-over containment liner system of claim 14, further comprising a connector plate having an outer downwardly extending side edge engaged in a top channel located in a top surface of the outer berm, and having an inner flat edge covering an edge portion of the rig mat.

16. The drive-over containment liner system of claim 1, wherein the inner berm comprises at least two inner berm sections connected end-to-end, and the outer berm comprises at least two outer berm sections connected end-to-end.

17. The drive-over containment liner system of claim 16, wherein the at least two inner berm sections are connected together by a tongue and groove, and the at least two outer berm sections are connected together by a tongue and groove.

18. The drive-over containment liner system of claim 16, further comprising a connector plate mechanically fastened to the at least two inner berm sections and mechanically fastened to the at least two other berm sections.

19. The drive-over containment liner system of claim 1, wherein the inner berm comprises two inner berm sections disposed at an angle of substantially 90 degrees with respect to each other, the outer berm comprises two outer berm sections disposed at an angle of substantially 90 degrees with respect to each other, and further comprising a corner piece attached to the two inner berm sections and attached to the two outer berm sections.

20. The drive-over containment liner system of claim 19, wherein the corner piece comprises an outer ramped surface contacting the outwardly facing ramp surfaces of the outer berm sections.

21. The drive-over containment liner system of claim 19, wherein the liner fold extends beneath the corner piece.

22. An outer berm section for use with a liquid impermeable liner of a drive-over containment liner system, the outer berm section comprising:

a base;

a sidewall extending upwardly from the base;

a top surface extending substantially perpendicularly from a top edge of the sidewall;

a perforated ramp surface extending downwardly at an angle from the top surface toward the base;

a channel formed in the top surface running along a length of the outer berm section structured and arranged to receive a downwardly extending side edge of a connector plate;

an end having an end groove therein; and another end having an end tongue therein, wherein the end groove is structured and arranged to engage an end tongue in a second outer berm section and the end tongue is structured and arranged to engage an end groove in a third outer berm section to thereby connect the outer berm sections together end-to-end.

23. An inner berm section for use with a liquid impermeable liner of a drive-over containment liner system, the inner berm section comprising:

a base;

a sidewall extending upwardly from the base;

a top surface extending substantially perpendicularly from a top edge of the sidewall;

a perforated ramp surface extending downwardly at an angle from the top surface toward the base;

a channel formed in the top surface running along a length of the inner berm section structured and arranged to receive a downwardly extending side edge of a connector plate;

an end having an end groove therein; and another end having an end tongue therein, wherein the end groove is structured and arranged to engage an end tongue in a second inner berm section and the end tongue is structured and arranged to engage an end groove in a third inner berm section to thereby connect the inner berm sections together end-to-end.

* * * * *